US008528568B2

(12) United States Patent
Onishi et al.

(10) Patent No.: US 8,528,568 B2
(45) Date of Patent: Sep. 10, 2013

(54) NON-COMBUSTIBLE SMOKING ARTICLE WITH CARBONACEOUS HEAT SOURCE

(75) Inventors: Masato Onishi, Yokohama (JP); Takeshi Akiyama, Yokohama (JP)

(73) Assignee: Japan Tobacco Inc., Tokyo (JP)

( * ) Notice: Subject to any disclaimer, the term of this patent is extended or adjusted under 35 U.S.C. 154(b) by 150 days.

(21) Appl. No.: 12/822,685

(22) Filed: Jun. 24, 2010

(65) Prior Publication Data

US 2010/0258139 A1 Oct. 14, 2010

Related U.S. Application Data

(63) Continuation of application No. PCT/JP2008/073109, filed on Dec. 18, 2008.

(30) Foreign Application Priority Data

Dec. 27, 2007 (JP) ..... 2007-338379

(51) Int. Cl.
*A24F 1/32* (2006.01)

(52) U.S. Cl.
USPC ..... 131/194; 131/361

(58) Field of Classification Search
USPC ..... 131/194, 361
See application file for complete search history.

(56) References Cited

U.S. PATENT DOCUMENTS

| | | | | |
|---|---|---|---|---|
| 4,714,082 | A | 12/1987 | Banerjee et al. | |
| 4,854,331 | A * | 8/1989 | Banerjee et al. | 131/194 |
| 4,922,901 | A * | 5/1990 | Brooks et al. | 128/203.26 |
| 4,955,397 | A * | 9/1990 | Johnson et al. | 131/194 |
| 5,135,009 | A | 8/1992 | Muller et al. | |
| 5,183,062 | A * | 2/1993 | Clearman et al. | 131/194 |
| 5,203,355 | A * | 4/1993 | Clearman et al. | 131/359 |
| 5,247,947 | A * | 9/1993 | Clearman et al. | 131/194 |
| 5,551,451 | A | 9/1996 | Riggs et al. | |
| 5,588,446 | A * | 12/1996 | Clearman | 131/194 |
| 5,944,025 | A * | 8/1999 | Cook et al. | 131/334 |
| 6,095,152 | A * | 8/2000 | Beven et al. | 131/194 |
| 2005/0172976 | A1 * | 8/2005 | Newman et al. | 131/194 |
| 2006/0201057 | A1 | 9/2006 | Hosoya et al. | |

FOREIGN PATENT DOCUMENTS

| | | | |
|---|---|---|---|
| JP | 61-092558 | A | 5/1986 |
| JP | 62-48370 | A | 3/1987 |
| JP | 6-311877 | A | 11/1994 |
| WO | WO 2005/046364 | A1 | 5/2005 |

OTHER PUBLICATIONS

International Search Report, PCT/ISA/210, mailed Mar. 24, 2009 in connection with PCT/JP2008/073109.

* cited by examiner

*Primary Examiner* — Richard Crispino
*Assistant Examiner* — Dionne Walls Mayes
(74) *Attorney, Agent, or Firm* — Birch, Stewart, Kolasch & Birch, LLP

(57) ABSTRACT

A non-combustible smoking article includes an aerosol-generating part including an aerosol-generating substance configured to generate aerosol by heating, and a heat source physically separated from the aerosol-generating part and disposed at an tip end of the aerosol-generating part, and configured to heat the aerosol-generating substance by combustion heat, in which the heat source includes at least one carbonaceous strip.

6 Claims, 4 Drawing Sheets

NON-COMBUSTIBLE SMOKING ARTICLE WITH CARBONACEOUS HEAT SOURCE

CROSS-REFERENCE TO RELATED APPLICATIONS

This is a Continuation Application of PCT Application No. PCT/JP2008/073109, filed Dec. 18, 2008, which was published under PCT Article 21(2) in Japanese.

This application is based upon and claims the benefit of priority from prior Japanese Patent Application No. 2007-338379, filed Dec. 27, 2007, the entire contents of which are incorporated herein by reference.

BACKGROUND OF THE INVENTION

1. Field of the Invention

The present invention relates to a non-combustible smoking article with a carbonaceous heat source.

2. Brief Description of Related Art

A cigarette is a representative example of the smoking articles by which tobacco is combusted so that the human can enjoy flavor and taste of smoke (aerosol) through the sense of taste and the sense of smell.

In recent years, non-combustible smoking articles by which the flavor and taste can be enjoyed without combusting tobacco have been developed for use in place of the cigarette or in addition to the cigarette (see, for example, JP S61-92558 A, JP S62-48370 A and JP H6-311877 A). Such a smoking article generally comprises an aerosol-generating part containing an aerosol-generating member in which an aerosol-generating substance is held on an appropriate substrate and a heat source disposed physically separately from the aerosol-generating part and configured to heat the aerosol-generating member by combustion heat to cause the same to generate aerosol. The heat source is formed of a cylindrical extruded solid product of a carbonaceous material containing carbon particles and a binder.

However, the heat source formed of an extruded product of a carbonaceous material is solid except for air inflow passageways, so that lighting the same is difficult as compared with lighting conventional cigarettes. Moreover, the non-combustible smoking article with the heat source formed of an extruded product of a carbonaceous material has the following problem in smoking a single article. That is, regarding the amount of smoke components per puff, the difference between the maximum value and the minimum value is large. Especially in the first 2 or 3 puffs, the amount of smoke components is small. Thus, with respect to this non-combustible smoking article, it has been found that constant averaged taste cannot be enjoyed on a single article.

BRIEF SUMMARY OF THE INVENTION

Therefore, it is an object of the present invention to provide a non-combustible smoking article with a carbonaceous heat source that can be lighted with relative easiness and that ensures a substantially constant averaged taste on a single article.

According to the present invention, there is provided a smoking article comprising: an aerosol-generating part comprising an aerosol-generating substance configured to generate aerosol by heating; and a heat source physically separated from the aerosol-generating part and disposed at an tip end of the aerosol-generating part, and configured to heat the aerosol-generating substance by combustion heat, wherein the heat source comprises at least one carbonaceous strip.

In the present invention, the carbonaceous strip may be in the form of a sheet. The sheet can be embossed or creped, or can have projections. Also, the sheet may be cylindrically shaped.

Further, in the present invention, the carbonaceous strip may be in a form of a thread, a fiber or a cut.

Still further, in the present invention, the heat source may comprise a plurality type of carbonaceous strips different in composition.

Moreover, in the present invention, the carbonaceous strip may be in such a form that is accommodated in a virtual cylinder.

DETAILED DESCRIPTION OF THE INVENTION

Figure 1A:
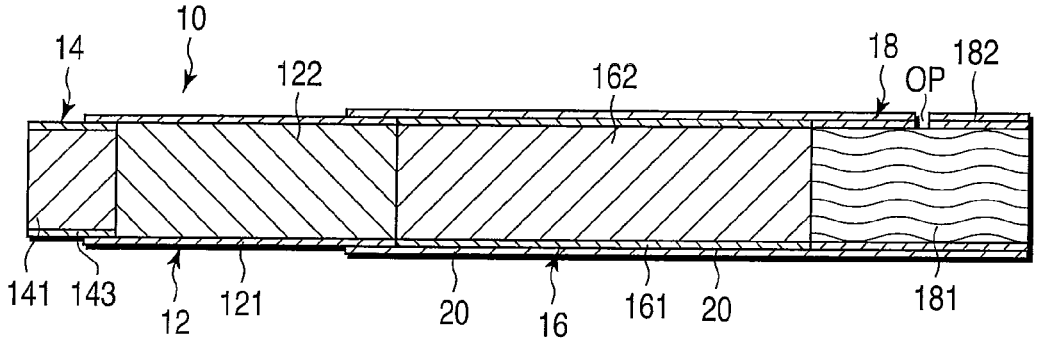
FIG. 1A is a schematic sectional view showing an example of the smoking article of the present invention.

The non-combustible smoking article of the present invention comprises an aerosol-generating part comprising an aerosol-generating substance configured to generate aerosol by heating, and a heat source physically separated from the aerosol-generating part and disposed at an tip end of the aerosol-generating part, and configured to heat the aerosol-generating substance by combustion heat. The heat source comprises at least one carbonaceous strip. The expression "physically separately" means that the aerosol-generating means and the heat source are disposed as physically separate members (separate bodies).

The aerosol-generating part of the non-combustible smoking article of the present invention comprises an aerosol-generating substance capable of generating an aerosol when heated. As the aerosol-generating substance, use can be made of, for example, a polyhydric alcohol, such as glycerin, propylene glycol, triethylene glycol or tetraethylene glycol, or an aliphatic ester of carboxylic acid, such as methyl stearate, dimethyl dodecanedioate or dimethyl tetradecanedioate. The aerosol-generating substance is usually supported on an appropriate carrier. A porous material, such as paper or activated charcoal, can be used as the carrier. The aerosol-generating substance is absorbed into or adsorbed on the porous material. Alternatively, a glucan gel, such as curdlan, described in Japanese Patent 3,118,462 can be used as the carrier. Specifically, an aerosol-generating substance is added to an aqueous dispersion of heat-irreversibly coagulating glucan, and the resultant mixture is cast in the form of a thin-film sheet on a support (for example, a stainless steel belt). Thereafter, the cast sheet is dried by heating to thereby gelatinize the glucan. The thus obtained glucan gel having the aerosol-generating substance supported thereon can be cut or pulverized for use in the aerosol-generating part.

The carrier having the aerosol-generating substance supported thereon (aerosol-generating member) can be accommodated in a cylindrical body formed of a nonflammable material, such as a paper sheet containing glass fibers, a ceramic or a paper sheet lined with a metal foil, thereby providing the aerosol-generating part.

The heat source fitted to the tip end of the aerosol-generating part contains at least one carbonaceous strip. The strip generally means a prolonged configuration. The strip means such a configuration that the length is greater than any of the dimensions for calculation of the area of a cross section along the direction perpendicular to the longitudinal direction, for example, the width, thickness and diameter (involving the major axis and minor axis). The strip may be in the form of a sheet, in the form of a thread, in the form of a fiber or in the form of cut such as cut tobacco. The strip also may assume a combination of these forms. When the carbonaceous strip is in the form of a sheet, as the contour of the heat source is generally circular, the carbonaceous strip may be shaped into the form of a cylinder (small cylinder) of diameter smaller than that of the circle of the heat source.

The carbonaceous strip is basically formed of a composition (heat source composition) comprising carbon (particulate or fibrous) and a binder for binding the carbon. The origin of the carbon for use is not particularly limited, and any of known carbons can be employed. The carbon can be contained in an amount of 1% by weight based on the total weight of the heat source composition. Generally, the carbon can constitute up to 80% of the total weight of the heat source composition.

Carboxymethylcellulose, an alginate (for example, ammonium alginate or potassium alginate) or the like can be used as the binder for binding carbon particles. The binder can be added in an amount of generally 0.01 to 50 parts by weight, preferably 0.011 to 2 parts by weight and more preferably 0.083 to 1.5 parts by weight to 1 part by weight of carbon.

The heat source composition can comprise an aerosol-generating substance in order to facilitate the generation of an aerosol at initial puffs. The same aerosol-generating substances as described above with respect to the aerosol-generating member can be used as the aerosol-generating substance that can be contained in the heat source composition. From the viewpoint of easiness in shaping the carbonaceous strip, the aerosol-generating substance that can be contained in the heat source composition is generally added in an amount of up to 98 parts by weight, preferably from 0.053 to 8.9 parts by weight and more preferably 0.167 to 3.5 parts by weight to 1 part by weight of carbon.

Moreover, the heat source composition can comprise calcium carbonate (particulate) or other inorganic additives in order to lower the highest combustion temperature of the heat source and thus reduce the volume of carbon monoxide generated. From the viewpoint of easiness in shaping the carbonaceous strip, these inorganic additives can be generally added in an amount of up to 98 parts by weight, preferably up to 8.4 parts by weight and more preferably 0.417 to 7.5 parts by weight to 1 part by weight of carbon.

Further, the heat source composition can comprise pulp, tobacco fine powder and the like. The pulp and tobacco fine powder can be added so that the total amount thereof is generally up to 98 parts by weight, preferably up to 3 parts by weight, to 1 part by weight of carbon. The pulp facilitates the shaping of the carbonaceous strip. The tobacco fine powder can improve the taste.

Still further, in the carbonaceous strip, a carbon monoxide reducing catalyst, such as boron, aluminum, silicon, titanium, iron, cobalt, nickel, zinc, germanium, zirconium, niobium, molybdenum, ruthenium, rhodium, palladium, silver, tin, cerium, hafnium, tantalum, tungsten, rhenium, osmium, iridium, platinum, gold, any of oxides of these elements or a mixture thereof, can be supported by adsorption or the like.

In the manufacturing of the carbonaceous strip in the form of a sheet, first, a base sheet is produced by adding water to the above heat source composition to prepare slurry, casting the slurry on a metal plate and drying the same. Alternatively, the base sheet can be produced by extruding the above heat source composition into a sheet. The carbonaceous strip that is in the form of a sheet can be obtained by cutting the produced base sheet at widths each corresponding to the axial length of the heat source. The carbonaceous strip that is in the form of cut, a thread or a fiber can be obtained by cutting the base sheet in a cut or a thread. Also, the carbonaceous strip that is in the form of a fiber can be obtained by extruding the above heat source composition into a fibrous form. Further, the carbonaceous sheet that is in the form of a small cylinder can be obtained by extrusion.

The carbonaceous strip according to the present invention can be used as the heat source in various forms. Generally, the carbonaceous strip can assume a form accommodated in a virtual cylinder. That is, the carbonaceous strip for making up the heat source can be formed as if the periphery thereof were circular. For example, the heat source can be formed by folding one carbonaceous strip in the form of a sheet so that a plurality of air passageways extending from the tip end to the rear end of the heat source are provided and so that the contour is substantially circular. Moreover, the heat source can be formed by spirally winding one carbonaceous sheet so that cavity exists in the central region; or by bundling a multiplicity of carbonaceous sheets being each in the form of a small cylinder so that the contour is circular; or by disposing a plurality of carbonaceous sheets being each in the form of a small cylinder at the circumferential region of the heat source and disposing a cylindrically wound carbonaceous sheet inside the plurality of carbonaceous sheets; or by winding one carbonaceous sheet into a cylindrical form and disposing in its interior a plurality of small cylinders each produced by winding a carbonaceous sheet. Further, the heat source can be formed by spirally winding a single thread or fiber of carbonaceous strip so that the contour is circular. Still further, the heat source can be formed by intertwining cuts of carbonaceous strip with one another so that the contour is circular. Furthermore, the heat source can be obtained by combining any two or more of these various forms with each other.

The heat source of the smoking article of the present invention can be formed of two or more types of carbonaceous strips different in compositions, and also can be formed of a combination of a carbonaceous strip with an extruded solid product of a carbonaceous material.

With respect to the heat source comprising a carbonaceous strip according to the present invention, especially when it is in the form of a sheet, it is substantially not needed to cover the entire circumference thereof with a heat insulating material, such as glass fibers, in order to prevent dropping and ensure the continuation of combustion by heat insulation effects unlike the conventional heat source formed of an extruded solid product. That is, the heat source comprising a carbonaceous strip according to the present invention, even when substantially the entire circumference thereof is exposed except that the rear end of the heat source is inserted in the tip end of a cylinder constituting the aerosol-generating part, can be free from dropping during combustion and can continue combustion. However, the entire circumference of the heat source comprising a carbonaceous strip according to the present invention can be covered with a paper sheet, such as any of conventional cigarette wrapping papers, a reconstituted tobacco sheet (for example, reconstituted tobacco sheet by a rolling method, slurry method or sheetmaking method or a non-woven reconstituted tobacco sheet) or a wrapping paper of high basis weight (basis weight of 50 g/m$^2$ or greater) or aluminum sheet or aluminum laminated paper. Alternatively, in circumstances, the entire circumference of the heat source comprising a carbonaceous strip according to the present invention can be covered with a carbonaceous sheet formed of the composition for constituting the carbonaceous strip for use in the present invention.

In the smoking article of the present invention, a flavor and taste generating part comprising a flavor and taste generating material can be attached to the rear end of the aerosol-generating part in order to impart a flavor and taste to the aerosol generated from the aerosol-generating part. As the flavor and taste generating material, use can be made of cut tobacco or flavor generating medium described in Japanese Patent No. 3,118,462. The flavor and taste generating material is accommodated in the same cylinder as that for the aerosol-generating part.

Furthermore, a filter as used in conventional cigarettes can be fitted to the rearest end of the smoking article of the present invention.

The smoking article of the present invention as a whole can have the outward appearance of conventional cigarettes.

Figure 1B:
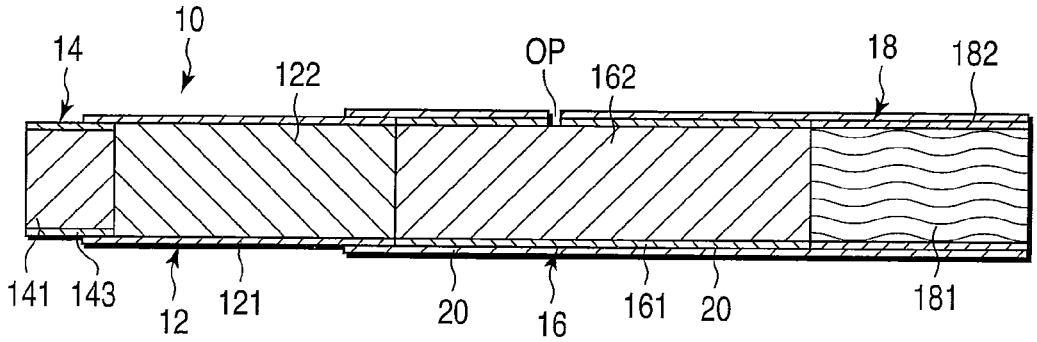
FIG. 1B is a schematic sectional view showing another example of the smoking article of the present invention.
Figure 1C:
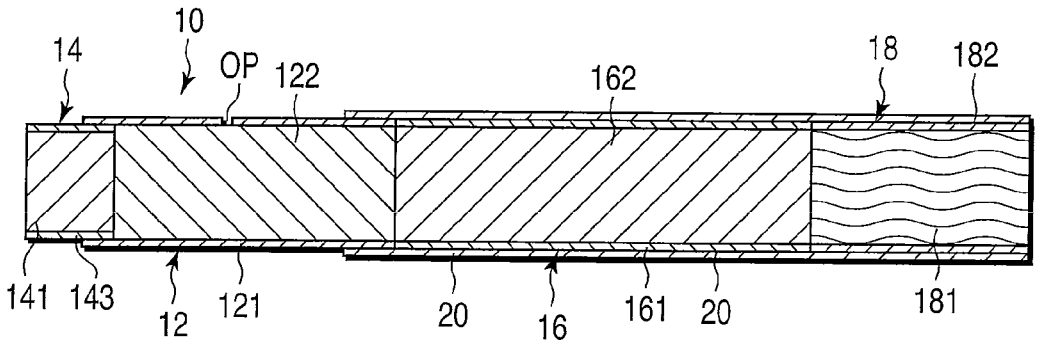
FIG. 1C is a schematic sectional view showing a further example of the smoking article of the present invention.
Figure 2A:
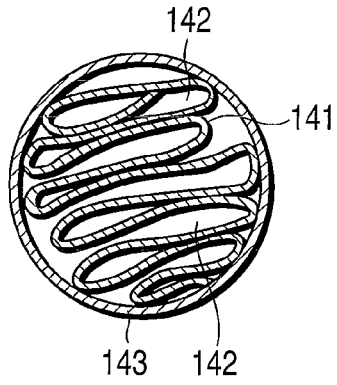
FIG. 2A is a slightly enlarged view showing the cross section of a heat source for use in the smoking article of the present invention.
Figure 2B:
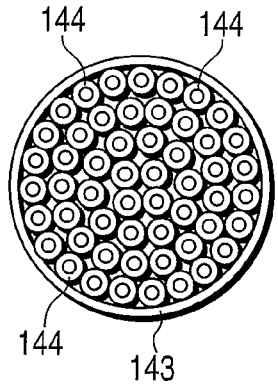
FIG. 2B is a slightly enlarged view showing the cross section of another heat source for use in the smoking article of the present invention.
Figure 2C:
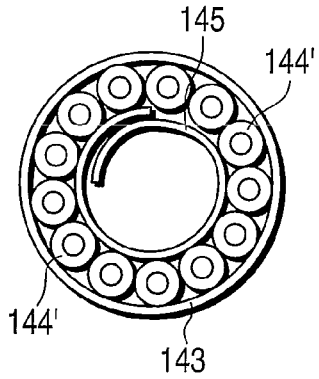
FIG. 2C is a slightly enlarged view showing the cross section of a further heat source for use in the smoking article of the present invention.
Figure 2D:
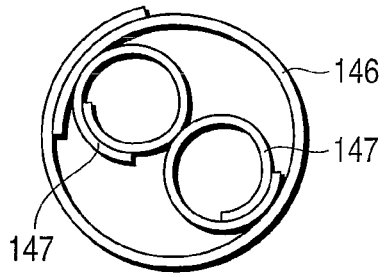
FIG. 2D is a slightly enlarged view showing the cross section of a still further heat source for use in the smoking article of the present invention.
Figure 2E:
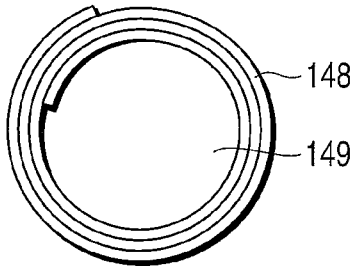
FIG. 2E is a slightly enlarged view showing the cross section of a still further heat source for use in the smoking article of the present invention.
Figure 2F:
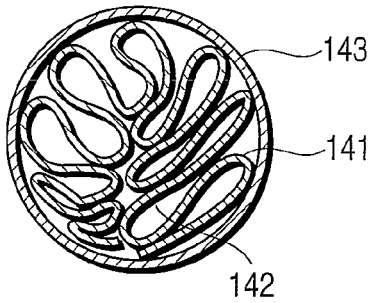
FIG. 2F is a slightly enlarged view showing the cross section of a still further heat source for use in the smoking article of the present invention.
Figure 2G:
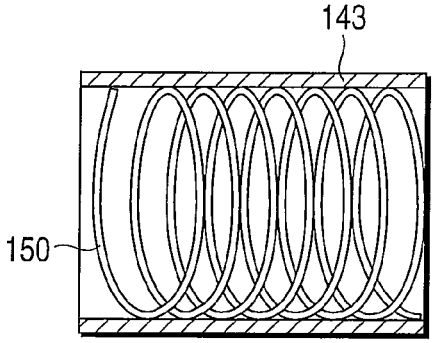
FIG. 2G is a view showing the longitudinal section of a heat source for use in the smoking article of the present invention.
Figure 2H:
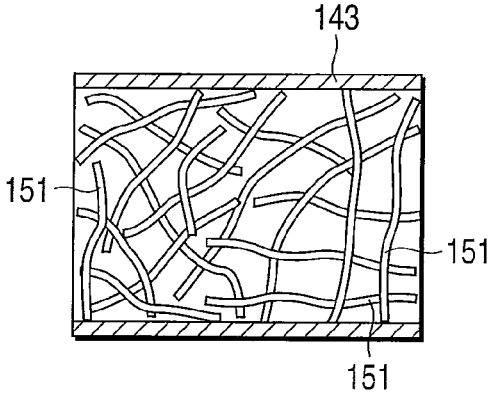
FIG. 2H is a view showing the longitudinal section of another heat source for use in the smoking article of the present invention.

FIGS. 1A to 1C are schematic sectional views showing examples of the smoking article of the present invention. FIGS. 2A to 2F are slightly enlarged views showing the cross sections of heat sources for use in the smoking article of the present invention. FIGS. 2G and 2H are views showing the longitudinal sections of heat sources for use in the smoking article of the present invention. FIGS. 1A to 1C show smoking articles that are identical to each other except for the position of an opening to be described in detail hereinafter.

Each of the smoking articles 10 shown in FIGS. 1A to 1C comprises an aerosol-generating part 12, a heat source 14 formed of carbonaceous strip disposed at the tip end of the aerosol-generating part 12, a flavor and taste generating part 16 disposed at the rear end of the aerosol-generating part 12 and a filter part 18 disposed at the rear end of the flavor and taste generating part 16.

The aerosol-generating part 12 includes a cylinder 121 formed of a nonflammable material. For example, a particulate aerosol-generating member 122 formed of a carrier having an aerosol-generating substance supported thereon is accommodated in the cylinder 121.

The contour of the heat source 14 is circular, and the heat source 14 can assume various forms as described above. Various forms are shown in FIGS. 2A to 2F. FIGS. 2A to 2F show the cross sections along the direction perpendicular to the longitudinal direction of the heat source 14. FIGS. 2G and 2H show the longitudinal sections of the heat source 14. In FIG. 2A, the heat source 14 is formed by folding one carbonaceous sheet 141 so that a plurality of air passageways 142 extending from the tip end to the rear end of the heat source 14 are provided and so that the contour is substantially circular. The circumference of the heat source 14 formed of the folded carbonaceous sheet 141 is wrapped with a cylindrical paper sheet 143. In FIG. 2B, the heat source 14 is formed by bundling a multiplicity of carbonaceous small cylinders 144 so that the contour of the whole thereof is circular. The circumference of the heat source 14 is wrapped with a cylindrical paper sheet 143. The internal spaces of the small cylinders 144 and the interstices between the small cylinders 144 constitute air passageways. In FIG. 2C, the heat source 14 is formed by cylindrically winding one carbonaceous sheet 145 so that cavity exists in the central region and disposing a plurality of carbonaceous small cylinders 144' only at the circumferential region of the cylinder formed by winding. The circumference of the heat source 14 is wrapped with a cylindrical paper sheet 143. In FIG. 2D, the heat source 14 is formed by winding one carbonaceous sheet 146 into a cylindrical form and disposing in its interior a plurality of small cylinders 147 each produced by winding a carbonaceous sheet. In FIG. 2E, the heat source 14 is formed by spirally winding one carbonaceous sheet 148 so that cavity 149 exists in the central region. In FIG. 2F, the heat source 14 is formed by folding one carbonaceous sheet 141 so that a plurality of air passageways 142 extending from the tip end to the rear end of the heat source 14 are provided, and so that the contour is substantially circular, and so that the folding direction is inverted halfway. The circumference of the heat source 14 formed of the folded carbonaceous sheet 141 is wrapped with a cylindrical paper sheet 143 in the same manner as in FIG. 2A. In FIG. 2G, the heat source 14 is formed by spirally winding a single thread or fiber of carbonaceous strip 150 so that the contour is circular. The circumference thereof is wrapped with a cylindrical paper sheet 143. In FIG. 2H, the heat source 14 is formed by intertwining a multiplicity of cut carbonaceous strips 151 with one another so that the contour is circular. The circumference thereof is wrapped with a cylindrical paper sheet 143. In all the above instances, the cylindrical paper sheet 143 can be regarded as being the virtual cylinder.

FIGS. 1A to 1C are referred to once more. The flavor and taste generating part 16 includes a cylinder 161 formed of a nonflammable material. A flavor and taste generating material 162 is accommodated in the cylinder 161.

The filter part 18 includes the same filter member 181 (for example, cellulose acetate fiber tow) as used in conventional cigarettes, and the circumference thereof is wrapped with a wrapping paper 182.

The aerosol-generating part 12, the flavor and taste generating part 16 and the filter part 18 are coupled together by means of a paper sheet 20, such as a cigarette wrapping paper, that covers the circumference of the rear end portion of the aerosol-generating part 12 and the entire circumferences of the flavor and taste generating part 16 and filter part 18.

The heat source 14 comprising a carbonaceous strip according to the present invention can be lighted using a lighter within a short period of time (for example, two seconds) in the same manner as for conventional cigarettes. After the lighting, when the smoking article 10 is sucked from its mouthpiece end portion (filter part 18), air is suctioned through the passageways 142 of the heat source 14 and is heated by the combustion heat of the heat source 14. The heated air while passing through the aerosol-generating part 12 heats the same, thereby generating aerosol. The generated aerosol passes through the flavor and taste generating part 16 (when exists) and heats the flavor generating part, thereby releasing flavor components. The aerosol accompanied by the flavor components is inhaled through the filter part 18 by the smoker. By virtue of the heat source of carbonaceous sheet according to the present invention, the smoking article can provide the taste substantially unvaried from the first or second puff to the last puff.

In order to dilute the mainstream smoke components (for example, carbon dioxide), the smoking article 10 can be provided with an opening for introducing air while smoking. The smoking article 10 shown in FIG. 1A is provided with an opening OP passing through the paper sheet 182 and nonflammable cylinder 121 in the filter part 18. The smoking article 10 shown in FIG. 1B is provided with an opening OP passing through the paper sheet 182 and nonflammable cylinder 121 in the flavor generating part 16. The smoking article 10 shown in FIG. 1C is provided with an opening OP passing through the nonflammable cylinder 121.

EXAMPLES

Now, the present invention will be described with reference to the Examples, which however in no way limit the scope of the present invention.

Example 1 and Comparative Examples 1 and 2

A mixture for carbonaceous sheet consisting of 30% by weight of carbon particles, 45% by weight of calcium carbonate, 15% by weight of glycerol and 10% by weight of ammonium alginate (binder) was mixed by means of a mixer. Water was added in an amount required for slurrying the mixture to the mixture, thereby obtaining a slurry. The slurry was further mixed. The slurry was cast on a metal plate repeatedly until the thickness after drying became about 0.15 mm. Thereafter, drying was performed for one hour in a thermostatic oven set to 80° C. The obtained carbonaceous sheet was cut into a size of 10 mm width and 90 mm length.

Non-combustible smoking article (trade name: Airs in which the aerosol-generating part 12 contains glycerol as the aerosol-generating substance and the flavor and taste generating part 16 contains cut tobacco as the flavor and taste generating material) having the same structure as in FIG. 1A except that the heat source was formed of an extruded solid product (cylindrical body) of a carbonaceous material (composition: 59.6% by weight of carbon particles, 12% by weight of calcium carbonate, 8.4% by weight of graphite, 10% by weight of ammonium alginate and 10% by weight of tobacco fine powder), the entire circumference thereof covered by glass fibers, was provided. The heat source was removed from the smoking article, and in place of the same, the above carbonaceous sheet was folded in the manner as shown in FIG. 2F and inserted in the smoking article without covering with a paper sheet, thereby obtaining the smoking article of the present invention (Example 1).

A heat source was produced by extruding a mixture of the same composition as that of the mixture employed in Example 1 into a solid cylindrical form and providing axial grooves as air passageways in the circumferential surface thereof. In the same manner as in Example 1, a smoking article (Comparative Example 1) was fabricated using this heat source.

Using the obtained smoking article sample of Example 1 and smoking article of Comparative Example 1 and the above-mentioned conventional smoking article (Airs, Comparative Example 2), smoking tests were carried out under Canadian intense smoking conditions (volume of smoke sucked 55 mL/2 sec; smoke sucking interval 30 seconds; and vent block 100%). At lighting, the smoking article of Comparative Example 1 and the smoking article of Comparative Example 2 had to be heated for 30 seconds using an electric lighter in accordance with the method of Tobacco Institute of Japan (TIOJ). In contrast, the smoking article sample of Example 1 could be lighted in the same period of 2 seconds as needed by conventional cigarettes.

The smoking article sample of the present invention, the smoking article of Comparative Example 1 and the smoking article of Comparative Example 2 were each sucked up to seven puffs. Upon each of the puffs, the smoke was trapped and the amount of total particulate matter (TPM) was measured. The results are given in Table 1 below.

TABLE 1

| Number of puffs | Amount of TPM per puff (mg) | | |
|---|---|---|---|
| (times) | Comp. Ex. 1 | Comp. Ex. 2 | Example 1 |
| 1 | 0.72 | 0.22 | 1.58 |
| 2 | 1.38 | 2.20 | 2.40 |
| 3 | 1.40 | 6.11 | 3.26 |
| 4 | 3.13 | 8.34 | 2.58 |
| 5 | 7.17 | 12.73 | 2.53 |
| 6 | 9.15 | 5.95 | 2.25 |
| 7 | 6.30 | 4.80 | — |

The results of Table 1 attest to an improvement in the amount of TPM during the initial stage of smoking (up to the third puff) attained by the smoking article of the present invention over the smoking article of Comparative Example 1 including the heat source of an extruded product. In particular, the smoking article including the heat source of an extruded product exhibits such a profile that the amount of TPM extremely increases at intermediate puffs (around the fifth puff and the sixth puff), thereby having a higher maximum. In contrast, with respect to the smoking article of the present invention, the extent of change in the amount of TPM per puff is small and the difference between the maximum value and the minimum value is reduced in the amount of TPM per puff. Accordingly, with respect to the smoking article of the present invention, it has been found that a substantially constant averaged taste can be enjoyed on a single article. Moreover, it has been ascertained that the smoking article of the present invention is improved over the conventional smoking article (Comparative Example 2) in the amount of TPM during the initial stage of smoking (up to the third puff). Further, the conventional smoking article exhibits such a profile that the amount of TPM extremely increases at intermediate puffs (around the fifth puff), thereby having a higher maximum. In contrast, with respect to the smoking article of the present invention, the extent of change in the amount of TPM per puff is small and the difference between the maximum value and the minimum value is reduced in the amount of TPM per puff. Accordingly, it is apparent that with respect to the smoking article of the present invention, a substantially constant averaged smoking taste can be enjoyed on a single article.

What is claimed is:

1. A non-combustible smoking article comprising: an aerosol-generating part comprising an aerosol-generating substance configured to generate aerosol by heating; and a heat source physically separated from the aerosol-generating part and disposed at a tip end of the aerosol-generating part, and configured to heat the aerosol-generating substance by combustion heat, wherein the heat source consists of at least one carbonaceous sheet, the carbonaceous sheet forming a plurality of air passageways.

2. The non-combustible smoking article according to claim 1, wherein the sheet is embossed or creped, or has projections.

3. The non-combustible smoking article according to claim 1, wherein the sheet is cylindrically shaped.

4. The non-combustible smoking article according to claim 1, wherein the heat source consists of a plurality of carbonaceous sheets different in composition.

5. The non-combustible smoking article according to claim 1, wherein the carbonaceous sheet is formed as if the periphery thereof were circular.

6. The non-combustible smoking article according to claim 1, wherein the sheet is folded.

* * * * *